United States Patent [19]

Detjen

[11] 4,152,960

[45] * May 8, 1979

[54] SAWMILL APPARATUS

[75] Inventor: Robert K. Detjen, Eau Claire, Wis.

[73] Assignee: McDonough Manufacturing Company, Eau Claire, Wis.

[ * ] Notice: The portion of the term of this patent subsequent to Mar. 1, 1994, has been disclaimed.

[21] Appl. No.: 805,553

[22] Filed: Jun. 10, 1977

Related U.S. Application Data

[63] Continuation-in-part of Ser. No. 772,152, Feb. 25, 1977, which is a continuation-in-part of Ser. No. 556,836, Mar. 10, 1975, Pat. No. 4,009,632.

[51] Int. Cl.[2] ..... B27B 7/00; B27B 29/08

[52] U.S. Cl. ..... 83/435.2; 83/731; 83/425.2; 144/312; 144/39; 198/627

[58] Field of Search ..... 83/731, 435.1, 435.2, 83/707, 425, 425.2; 198/627, 626, 620, 604; 144/312, 41, 39

[56] References Cited

U.S. PATENT DOCUMENTS

| | | | |
|---|---|---|---|
| 1,913,001 | 6/1933 | Ross | 198/627 |
| 2,332,654 | 10/1943 | Mead et al. | 198/620 |
| 3,731,578 | 5/1973 | Ackerfeldt | 83/731 |
| 3,747,455 | 7/1973 | Hartzell et al. | 83/435.1 |

*Primary Examiner*—Donald R. Schran

*Attorney, Agent, or Firm*—Beveridge, DeGrandi, Kline & Lunsford

[57] ABSTRACT

A log is moved forwardly in a longitudinal path through a saw while engaged between a pusher dog and a holdback dog. The dogs are supported respectively by a pair of endless carriers which are parallel and adjacent to each other on one side of the log path. The log is scanned and rotationally oriented before being engaged by simultaneous forward movement of the pusher dog and rearward movement of the holdback dog. Forward movement carries the log first to a chipper head and then to a guide surface which engages the face cut by the chipper head for stabilizing the log during sawing.

31 Claims, 4 Drawing Figures

SAWMILL APPARATUS

REFERENCE TO RELATED APPLICATIONS

This is a continuation-in-part of application Ser. No. 772,152 filed Feb. 25, 1977, which is a continuation-in-part of my earlier application Ser. No. 556,836 filed Mar. 10, 1975, now U.S. Pat. No. 4,009,632. The entirety of said earlier applications is incorporated hereby by reference.

BACKGROUND AND SUMMARY OF THE INVENTION

This invention relates to improvements in sawmill apparatus, pertaining to the means for engaging logs and advancing them longitudinally through the saw blades.

As in my earlier applications referred to above, the present invention pertains to apparatus having a first endless carrier supporting a driven pusher dog for engaging the rear end of a log, and a second endless carrier supporting a retarded holdback dog for engaging the forward end of a log. In the present instance, however, both carriers are located on a same side of the log. When used in conjunction with circular saws, the dogs themselves project into the space between the saw blades, but the width-consuming dog-supporting elements are located outside the space between the saw blades, making it possible to move the blades closer together to provide a narrower heart cant than in my earlier apparatus. Further, the present apparatus adapts itself particularly well to use in conjunction with scanning apparatus and with a chipper head for forming a guide surface on the bottom face of a log.

BRIEF DESCRIPTION OF THE PREFERRED EMBODIMENTS

Figure 1:
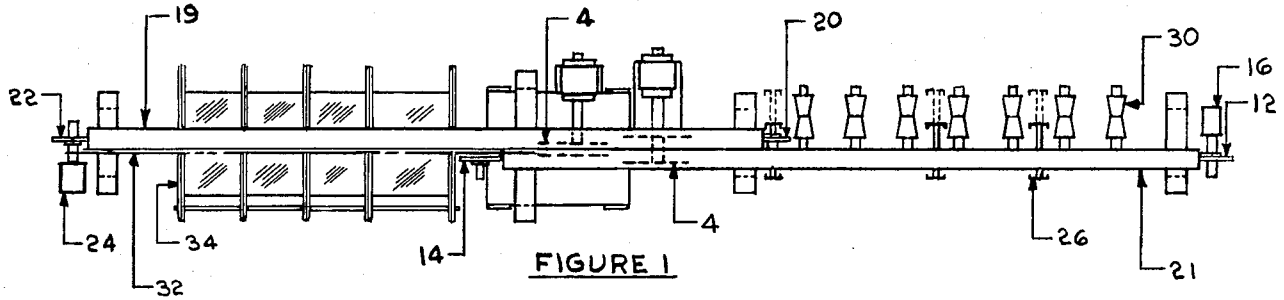
FIG. 1 is a schematic plan view of a sawmill apparatus constructed according to the invention.
Figure 2:
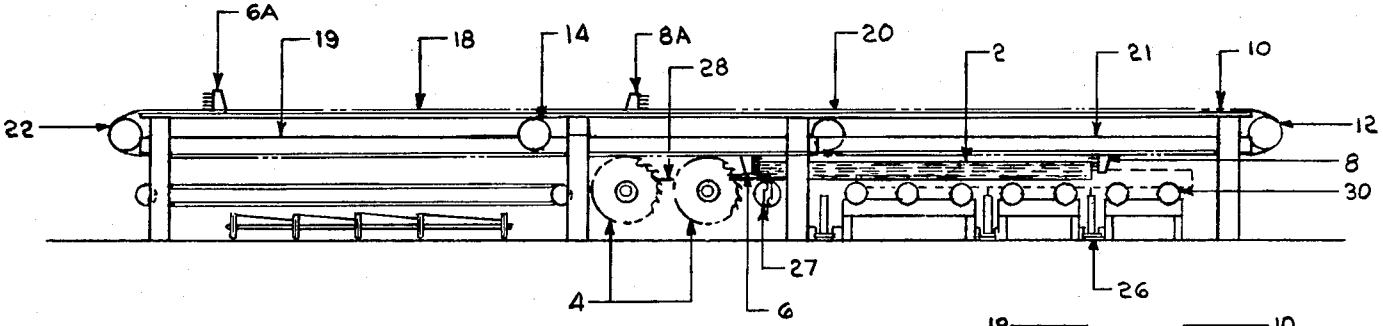
FIG. 2 is a side elevational view of the apparatus of FIG. 1.

FIGS. 1 and 2 show a log 2 supported on the apparatus for movement through the circular saw blades 4 which are rotated about transverse axes located below the log. The log is retained at its forward end by a holdback dog 6, and at its rear end by a pusher dog 8.

The pusher dog 8 is connected to a chain 10, the opposite ends of which are supported on a pair of sprockets 12 and 14. The chain is appropriately guided between the sprockets 12 and 14 in any suitable manner, and the sprocket 12 is driven by a drive motor 16 to advance the chain 10 and dog 8 in a forward direction toward the saw blades 4. Holdback dog 6 is carried by an endless chain 18, the rear portion of which passes over a sprocket 20. Its forward end engages a sprocket 22 driven by a reversible hydraulic motor 24. Preferably, all sprockets 12, 14, 20 and 22 are of the same diameter and their axes of rotation are in a common plane.

For ease in understanding the drawings, the sprockets are shown of different sizes in FIG. 2.

Figure 3B:
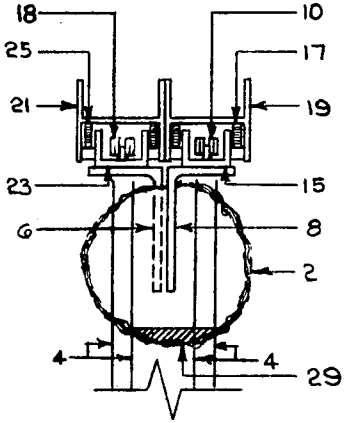
FIG. 3B is an enlarged forward-looking end view showing details of the log-engaging dogs and their supports.

While being cut by the blades 4, the log 2 moves along a path directly beneath the chains 10 and 18, the forward and rearward ends of the log being engaged respectively by the dogs 6 and 8. Each dog assembly preferably includes a roller-supported carriage connected to the chain and provided with a dog which is located downwardly and laterally inwardly of its respective chain, the dogs moving along paths between the saw blades and the carriages moving along paths displaced from the space between the saw blades. As shown in FIG. 3B, the pusher dog 8 is supported on carriage 15 which has rollers 17 riding on a track within an I-beam rail 19. While moving along its working path and engaging the trailing end of a log, the pusher dog 8 is located downwardly and inwardly of its drive chain 10.

The holdback dog 6 is supported on a track in I-beam rail 21 by a carriage 23 provided with rollers 25. As shown in FIG. 3B, the holdback dog is positioned downwardly and inwardly of its drive chain 18, at a minimum distance from the path of pusher dog 8. The space-consuming dog-supporting and driving means move along paths displaced from the space between the saw blades, making it possible to provide a relatively narrow heart cant if desired.

Figure 3A:
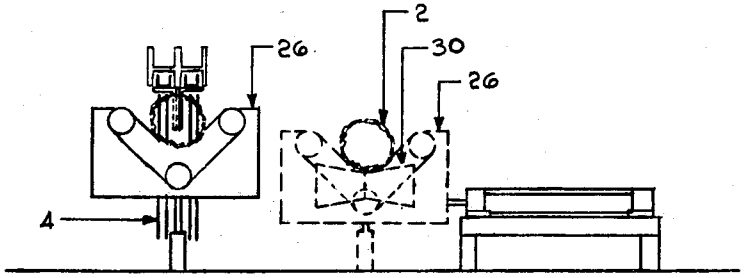
FIG. 3A is a forward-looking end view of portions of the apparatus, showing also a mechanism for delivering logs to the apparatus, two positions of this mechanism being shown respectively in broken and solid lines.

Prior to being engaged by the dogs 6 and 8, the log is supported on a set of V-blocks 26 located at the position shown in solid lines in FIG. 3A. Simultaneously, the motor 16 drives the dog 8 forwardly and the motor 24 drives the dog 6 rearwardly so that spurs in the dogs engage the opposite ends of the log for firm retention thereof. The motor 24 is then deactivated and the flow of hydraulic fluid therethrough is restricted but not stopped so that the motor 24 will resist movement of the chain 18 and therefore cause the dog 6 to deliver a retarding force to the forward end of the log 2. The motor 16 continues to operate to drive the pusher dog 8 forwardly against the resistive force of the holdback dog 6, advancing the log along its path toward the saw blades 4.

A chipper head 27 is located in the path of the advancing log, set to remove only about one quarter inch from the bottom face of the log and provide a flat planed surface thereunder. The portion to be removed is designated 29 in FIG. 3B. This planar surface is directly aligned with the skid plate 28 which remains in contact with the log throughout the sawing operation. The skid plate 28 tends to stabilize the log and prevent it from being moved with respect to the dogs 6 and 8 during the time the log 2 is being sawed by the circular blades 4.

After the log has completed its movement through the saw blades 4, the sawn pieces thereof are removed by any conventional machinery such as the heart cant discharge chain 32 and the slab and side board discharge chains 34. At this time, the motor 24 is activated in a forward direction to advance a second holdback dog 6*a* to a position immediately forward of the position to be occupied by the next log engaged thereby.

Preferably, a second pusher dog 8*a* is located on the chain 10 and an additional holdback dog 6*a* is located on the chain 18, these dogs being spaced one half the chain length from their respective dogs 6 and 8 to reduce the extent of chain movement required to return the apparatus to its initial or starting position.

One procedure for handling the incoming logs involves a set of hourglass rolls 30, and a set of elevatable and translatable V-blocks 26. The log 2 is initially placed on the hourglass rolls 30 and then advanced longitudinally approximately three feet past the scanners which are known in the art for the purpose of ascertaining the optimum log orientation for lumber utilization. After the log is scanned, it is rotated to the optimum orientation. Hydraulic cylinders then raise the V-blocks 26, elevating the log 2 to the position shown in dot-dash lines in FIG. 3A. Then the V-blocks 26 are translated by another hyraulic motor to the loading station in the central longitudinal plane of the apparatus i.e. to the position shown in solid lines in FIG. 3A. Then, as previously explained, the holdback dog 6 is moved rearwardly so its spurs engage the forward end of the log, the pusher dog 8 is moved forwardly so that its spurs engage the rearward end of the log, and then the log is advanced past the chipper head 27 and through the saw blades 4.

As the invention may assume many forms other than the disclosed preferred embodiment, it is emphasized that the invention is not limited to the disclosed embodiment but is encompassing of innumerable variations thereof within the spirit of the following claims.

I claim:

1. Sawmill apparatus comprising a first endless carrier, a second endless carrier disposed parallel and adjacent to said first endless carrier, a pusher dog supported on said first carrier, a holdback dog supported on said second carrier, first drive means for advancing said first carrier and said pusher dog along a given path to advance a log engaged thereby longitudinally through a saw assembly, said carriers both being on the same side of the log path, means imposing on said second carrier a retarding force resisting movement of a log engaged by said holdback dog in a forward direction along the longitudinal path of the log, and saw means positioned in the path of a log moving through said apparatus, said saw having an infeed side and an outfeed side, said first endless carrier extending from the infeed side of the saw to the outfeed side of the saw, said second endless carrier extending from the infeed side of the saw to the outfeed side of the saw.

2. The apparatus of claim 1 having second drive means for moving said holdback dog in a rearward direction initially to engage a log prior to sawing, and means for driving said second carrier means in a forward direction after a log is sawn.

3. The apparatus of claim 1 wherein said saw is a circular saw rotatable about a saw axis located on one side of the path of a log moving through the apparatus, both of said carrier means being on an opposite side of said path from said saw axis.

4. The apparatus of claim 1 having means for orienting said log prior to its engagement by said dogs.

5. The apparatus of claim 1 having a chipper head located in the path of a log advancing therethrough to remove one face therefrom, support means located downstream of said chipper head for engaging and guiding the face of the log formed by the chipper head.

6. The apparatus of claim 5 wherein the support means extends to a location adjacent the saw means, said saw means being a circular saw having a direction of rotation tending to move said log against said support means.

7. The apparatus of claim 1 wherein said saw means includes a pair of parallel saw blades separated by a space, carriage means connected to said endless carriers for supporting said dogs, said carriage means being movable in a path displaced from said space between said saw blades.

8. The apparatus of claim 7 wherein said carrier means are displaced from said space between the saw blades.

9. The apparatus of claim 7 wherein said saw blades are rotatable about a saw axis located on one side of the path of a log moving through the apparatus, both of said carrier means being on an opposite side of said path from said saw axis.

10. The apparatus of claim 7 having a chipper head located in the path of a log advancing therethrough to remove one face therefrom, support means located downstream of said chipper head for engaging and guiding the face of the log formed by the chipper head.

11. The apparatus of claim 10 wherein the support means extends to a location adjacent the saw means, said saw blades having a direction of rotation tending to move said log against said support means.

12. The apparatus of claim 10 wherein said saw blades are rotatable about a saw axis located on one side of the path of a log moving through the apparatus, both of said carrier means being on an opposite side of said path from said saw axis.

13. Sawmill apparatus comprising a first endless carrier, a pusher dog supported on said first carrier, a second endless carrier, a holdback dog supported on said second carrier, first drive means for advancing said first carrier and said pusher dog along a given path to advance a log engaged thereby longitudinally through a saw, means for initially moving said holdback dog rearwardly to engage a log prior to sawing, means imposing on said holdback dog a retarding force resisting movement in a forward direction along the longitudinal path of the log whereby during sawing a log is grasped between the driven pusher dog and the retarded holdback dog, and saw means positioned in the path of a log moving through said apparatus, said saw having an infeed side and an outfeed side, said first endless carrier extending from the infeed side of the saw to the outfeed side of the saw, said second endless carrier extending from the infeed side of the saw to the outfeed side of the saw.

14. The apparatus of claim 13 having means for driving said second carrier means in a forward direction away from a log after the log is sawn.

15. The apparatus of claim 13 having means for driving said second carrier means after a log is sawn to position a holdback dog in an initial position in the path of a subsequent log to be sawn.

16. The apparatus of claim 13 wherein said saw is a circular saw rotatable about a saw axis located on one side of the path of a log moving through the apparatus, both of said carrier means being on an opposite side of said path from said saw axis.

17. The apparatus of claim 13 having means for orienting said log prior to its engagement by said dogs.

18. The apparatus of claim 13 having a chipper head located in the path of a log advancing therethrough to remove one face therefrom, support means located downstream of said chipper head for engaging and guiding the face of the log formed by the chipper head.

19. The apparatus of claim 18 wherein the support means extends to a location adjacent the saw means, said saw means being a circular saw having a direction of rotation tending to move said log against said support means.

20. The apparatus of claim 18 wherein said saw means includes a pair of parallel saw blades separated by a space, carriage means connected to said endless carriers for supporting said dogs, said carriage means being movable in a path displaced from said space between said saw blades.

21. The apparatus of claim 20 wherein said carrier means are displaced from said space between the saw blades.

22. The apparatus of claim 20 wherein said saw blades are rotatable about a saw axis located on one side of the path of a log moving through the apparatus, both of said carrier means being on an opposite side of said path from said saw axis.

23. The apparatus of claim 20 having a chipper head located in the path of a log advancing therethrough to remove one face therefrom, support means located downstream of said chipper head for engaging and guiding the face of the log formed by the chipper head.

24. The apparatus of claim 23 wherein the support means extends to a location adjacent the saw means, said saw blades having a direction of rotation tending to move said log against said support means.

25. The apparatus of claim 23 wherein said saw blades are rotatable about a saw axis located on one side of the path of a log moving through the apparatus, both of said carrier means being on an opposite side of said path from said saw axis.

26. A sawmill log handling method for advancing logs along a machine axis from an infeed side of a saw, through the saw and to an outfeed side of the saw, said method comprising the steps of, positioning the log with its longitudinal axis substantially parallel to said machine axis, engaging a forward end of a log with a forward holdback dog by moving the holdback dog rearwardly against the forward end of the log, driving the log and the holdback dog engaged therewith forwardly by moving a pusher dog engaged with the rear end of the log along said machine axis, imposing a rearward force on the holdback dog during its forward movement to clamp the log between the pusher dog and the holdback dog, sawing the log as it is engaged by both dogs and moved forwardly along the machine axis.

27. The method of claim 26 including the step of chipping the log with a chipper head to provide a planar surface thereon as the log is engaged by both dogs and advanced along the machine axis.

28. The method of claim 26 wherein said positioning of the log includes the step of rotating the log to its optimum orientation for lumber utilization.

29. A sawmill log handling method for advancing logs along a machine axis from an infeed side of a circular saw, through the saw and to the outfeed side of the saw, said method comprising the steps of:

rotating the saw about an axis which is spaced from and lies substantially perpendicular to said machine axis, engaging the log between a forward holdback dog supported on a first carrier and a rear pusher dog supported on a second carrier, said carriers being located on an opposite side of the machine axis from said saw axis, moving the log forwardly by driving said rear pusher dog forwardly while imposing a rearward force on the forward holdback dog to clamp the log between said dogs, said dogs moving during such movement through an area which is displaced radially from the saw axis and displaced axially from the saw.

30. The method of claim 29 including the step of chipping the log with a chipper head to provide a planar surface thereon as the log is engaged by both dogs and advanced along the machine axis.

31. The method of claim 29 wherein said positioning of the log includes the step of rotating the log to its optimum orientation for lumber utilization.

* * * * *